US010914109B2

(12) United States Patent
Shinmura

(10) Patent No.: US 10,914,109 B2
(45) Date of Patent: Feb. 9, 2021

(54) HINGE DEVICE

(71) Applicant: Sugatsune Kogyo Co., Ltd., Tokyo (JP)

(72) Inventor: Ken Shinmura, Tokyo (JP)

(73) Assignee: SUGATSUNE KOGYO CO., LTD., Tokyo (JP)

( * ) Notice: Subject to any disclaimer, the term of this patent is extended or adjusted under 35 U.S.C. 154(b) by 0 days.

(21) Appl. No.: 16/394,479

(22) Filed: Apr. 25, 2019

(65) Prior Publication Data

US 2019/0330899 A1 Oct. 31, 2019

(30) Foreign Application Priority Data

Apr. 25, 2018 (JP) ..... 2018-083753

(51) Int. Cl.
*E05F 1/08* (2006.01)
*E05F 1/12* (2006.01)
*E05D 3/02* (2006.01)

(52) U.S. Cl.
CPC ..... *E05F 1/1223* (2013.01); *E05D 3/02* (2013.01); *E05Y 2201/41* (2013.01); *E05Y 2201/474* (2013.01); *E05Y 2600/626* (2013.01)

(58) Field of Classification Search
CPC ..... Y10T 16/304; Y10T 16/2771; Y10T 16/5382; Y10T 16/5386; Y10T 16/53828; Y10T 16/552; Y10T 16/53862; Y10T 16/538627; Y10T 16/538633; Y10T 16/53888; Y10T 16/5389; Y10T 16/5402; A47F 3/043; A47F 3/0434; A47F 2003/008; E05D 7/081; E05D 7/0027; E05D 7/0009; E05F 3/06; E05F 3/20; E05F 1/12; E05F 1/1223; E05F 1/1008; E05F 1/1025; E05F 1/1207; E05F 1/1215; E05F 1/14; E05Y 2201/21; E05Y 2201/25; E05Y 2201/41; E05Y 2201/484; E05Y 2201/492; E05Y 2201/496; E05Y 2201/702; E05Y 2201/704; E05Y 2201/71; E05Y 2600/12;
(Continued)

(56) References Cited

U.S. PATENT DOCUMENTS 753,998 A * 3/1904 Moore ..... E05F 1/1066 16/72
987,467 A * 3/1911 Katzenberger ..... E05D 3/00 16/281
(Continued)

FOREIGN PATENT DOCUMENTS

JP S62-163280 U 10/1987
JP 08004406 A * 1/1996
(Continued)

OTHER PUBLICATIONS

Japanese Office Action dated Jun. 2, 2020, issued in Japanese Application No. 2018-083753, 8 pages with translation.

*Primary Examiner* — Chuck Y Mah
(74) *Attorney, Agent, or Firm* — Masuvalley & Partners

(57) ABSTRACT

In a hinge device comprising a first member attached to a main body, a second member attachable to a door and rotatable about a vertical rotation axis with respect to the first member, a cam provided in the first member, and a linear damper provided in the second member and actuatable by the cam, the linear damper is disposed below the lower surface of the door.

4 Claims, 9 Drawing Sheets

(58) Field of Classification Search
CPC ..... E05Y 2900/132; E05Y 2900/20; E05Y 2900/202; E05Y 2900/30
See application file for complete search history.

(56) References Cited

U.S. PATENT DOCUMENTS 1,653,448 A * 12/1927 Bommer ..... E05D 11/1064 16/284
1,666,903 A * 4/1928 Hubbs ..... E05F 3/104 16/55
2,035,823 A * 3/1936 Moore ..... E05D 11/1064 16/284
2,072,094 A * 3/1937 Bommer ..... E05F 3/20 16/299
2,413,475 A * 12/1946 Walts ..... E05F 1/1253 16/281
2,603,818 A * 7/1952 Carlson ..... E05D 7/081 16/55
3,657,766 A * 4/1972 Peterson ..... E05D 3/022 16/281
3,763,519 A * 10/1973 Favre ..... E05F 1/105 16/72
4,000,540 A * 1/1977 Newlon ..... E05F 1/1253 16/298
4,583,262 A * 4/1986 Werner ..... E05F 1/1215 16/300
5,219,372 A * 6/1993 Lee ..... E05F 3/08 16/54
5,383,253 A * 1/1995 Lin ..... E05F 3/20 16/299
6,161,255 A * 12/2000 Garrett ..... A47K 3/36 16/284
7,111,358 B1 * 9/2006 Jackson ..... E05F 1/1215 16/50
7,305,796 B2 * 12/2007 Chiang ..... E05D 5/0246 16/252
8,984,717 B1 * 3/2015 Jackson ..... E05F 1/1253 16/273
9,095,214 B2 * 8/2015 White ..... E05F 1/1253
9,926,733 B2 * 3/2018 Bacchetti ..... E05F 3/10
2004/0093689 A1 * 5/2004 Sosa ..... E05D 7/04 16/301
2005/0044661 A1 * 3/2005 Cho ..... E05F 1/1215 16/76
2005/0177975 A1 * 8/2005 Wang ..... E05F 3/04 16/60
2007/0000090 A1 * 1/2007 Wu ..... E05F 1/1215 16/299
2007/0113378 A1 * 5/2007 Talpe ..... E05F 1/1215 16/298
2008/0127452 A1 * 6/2008 Jackson ..... E05D 7/081 16/50
2010/0024159 A1 * 2/2010 Oh ..... E05F 3/104 16/54
2010/0109497 A1 * 5/2010 Blersch ..... E05F 1/1253 312/405
2010/0281650 A1 * 11/2010 Kleemann ..... E05F 5/02 16/64
2011/0187255 A1 * 8/2011 Ryu ..... F25D 23/028 312/405
2014/0068894 A1 * 3/2014 Nagl ..... E05F 1/1215 16/307
2015/0218864 A1 * 8/2015 Simon ..... A47F 3/043 16/321
2017/0030125 A1 * 2/2017 Bacchetti ..... E05F 3/10

FOREIGN PATENT DOCUMENTS

JP 10169301 A * 6/1998
JP 2013-500410 A 1/2013
WO WO2011-009557 A2 1/2011

* cited by examiner

FIG. 9
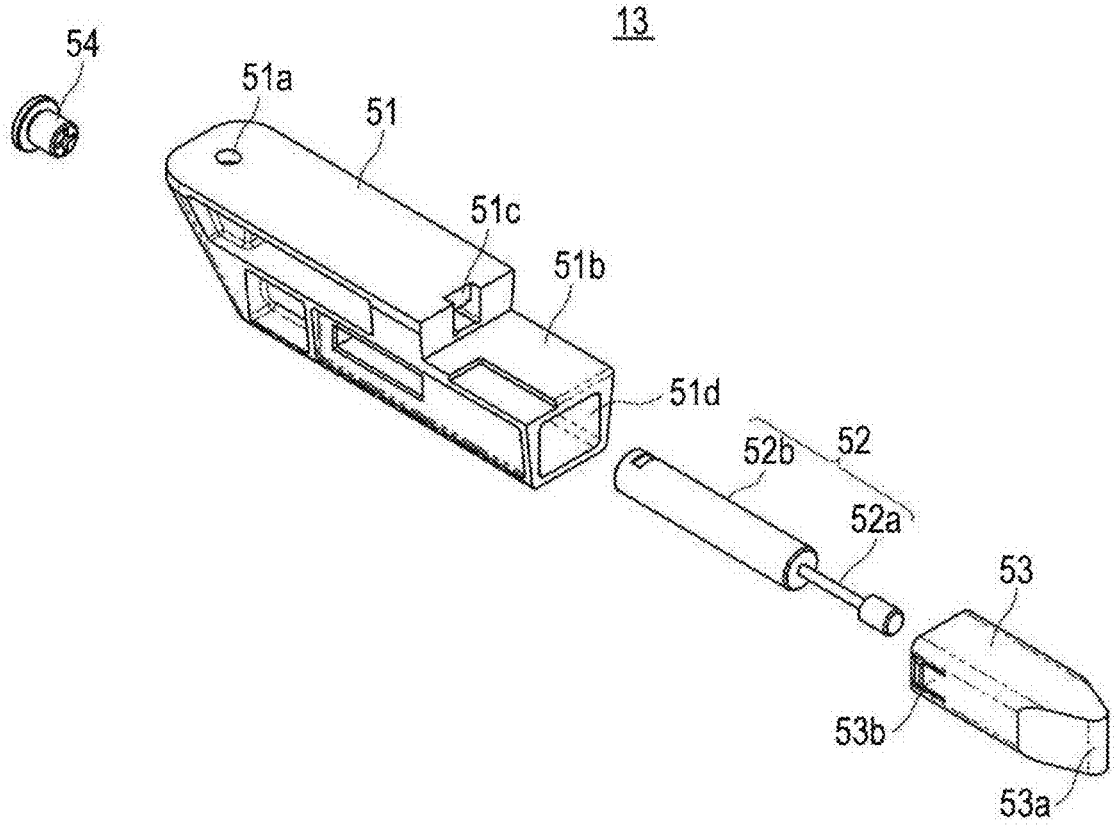
FIG. 10A
FIG. 10B
FIG. 10C
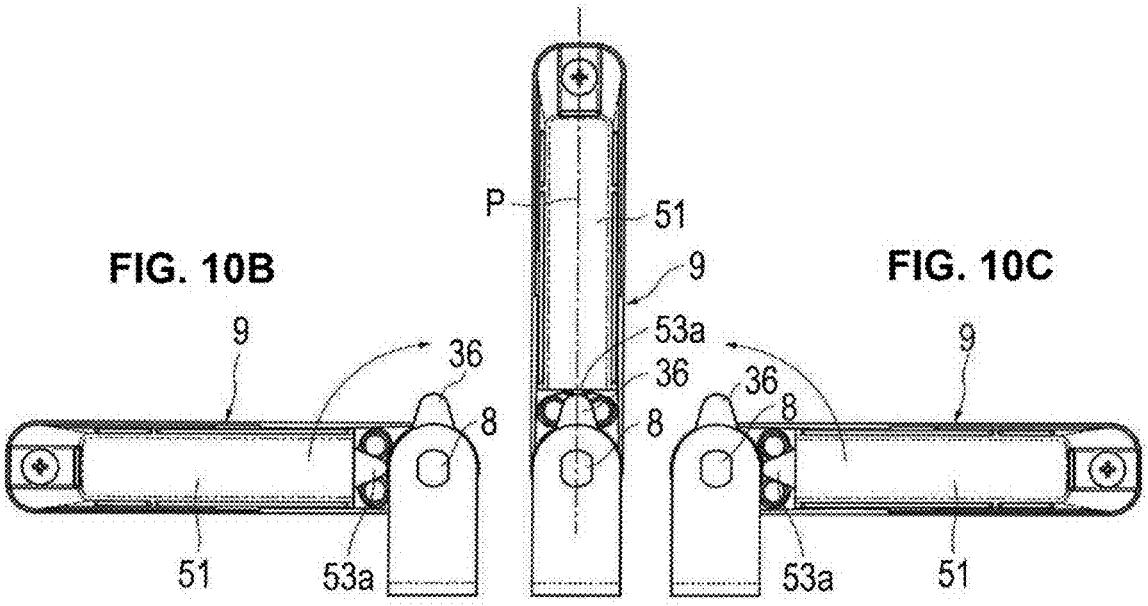

HINGE DEVICE

RELATED APPLICATIONS

This application claims priority to Japanese Patent Application No. 2018-083753 filed Apr. 25, 2018 which is hereby incorporated herein by reference in its entirety.

BACKGROUND OF THE INVENTION

Field of the Invention

The present invention generally relates to a hinge device, and more particularly to a hinge device with a linear damper.

Description of the Background Art

Providing a hinge device with a linear damper makes a door to move slowly in the vicinity of a closed or an open position. For the reason that the slow movement of the door may create an upscale impression on the door, the hinge device is often provided with a linear damper.

As an example of a hinge device with a linear damper, Japanese patent application publication JP 2013-500410 A, corresponding to WO 2011/009557 A2, discloses a hinge device comprising a fixed member attached to a main body of a frame or equivalent, a movable member attached to a door, and a shaft passing through the fixed member and the movable member. A linear damper is provided on the movable member so as to rotate about the shaft together with the movable member. The shaft is provided with a cam for actuating the linear damper. When the door moves close to its closed or open position, the linear damper is actuated by the cam, thereby rendering the door to move slowly.

Provision of the hinge device with a linear damper causes the hinge device to be more bulky in size than a hinge without a linear damper. For attaching the hinge device with linear damper to an existing door, the door has to be cut according to the shape of the hinge device with the linear damper to form a notch, to which the hinge device with the linear damper will be fitted.

However, it takes time to form notches on the door, and the appearance of the door becomes impaired.

SUMMARY OF THE INVENTION

It is an object of the present invention to provide a hinge device with a linear damper capable of minimizing machining of a door.

In order to overcome the difficulties stated above, one aspect of the invention is directed to a hinge device which comprises a first member attached to a main body, a second member attachable to a door and rotatable about a vertical rotation axis with respect to the first member, a cam provided to the first member, and a linear damper attached to the second member and actuatable by the cam, wherein the linear damper is disposed below a lower surface of the door or above an upper surface of the door.

In accordance with the present invention, since the linear damper is disposed below the lower surface of the door or above the upper surface of the door, it is not necessary to form a notch for fitting the linear damper on the door. Thus, the machining of the door can be minimized.

BRIEF DESCRIPTION OF THE DRAWINGS

The objects and features of the present invention will become more apparent from consideration of the following detailed description taken in conjunction with the accompanying drawings in which:

FIG. 5C shows a state where the case is rotated clockwise;

FIG. 9 is an exploded perspective view of the damper structure; and

FIGS. 10A through 10C schematically depict an operation of the damper structure, FIG. 10A showing a neutral position of the case, FIG. 10B showing a state where the case is rotated counterclockwise by about 90 degrees from its neutral position, and FIG. 10C showing a state where the case is rotated clockwise by about 90 degrees from its neutral position).

DESCRIPTION OF THE PREFERRED EMBODIMENTS

Hereinafter, a hinge device according to an embodiment of the present invention will be described in detail with reference to the accompanying drawings. In this regard, the hinge device of the present invention may be embodied in various aspects and is not limited to the embodiment described in this specification. The illustrative embodiment is provided with intent to sufficiently provide the disclosure in the specification for facilitating those skilled in in the art to sufficiently understand the scope of the invention.

Figure 1A:
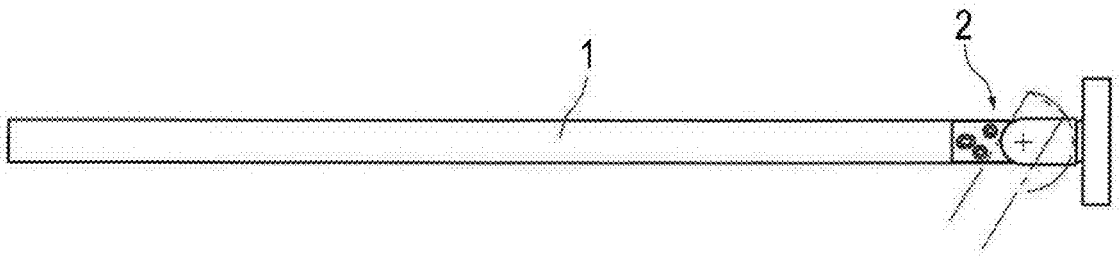
FIGS. 1A and 1B show an example of a hinge device according to an embodiment of the present invention attached to a counter door, FIG. 1A and FIG. 1B being a plan and a side view, respectively.
Figure 1B:
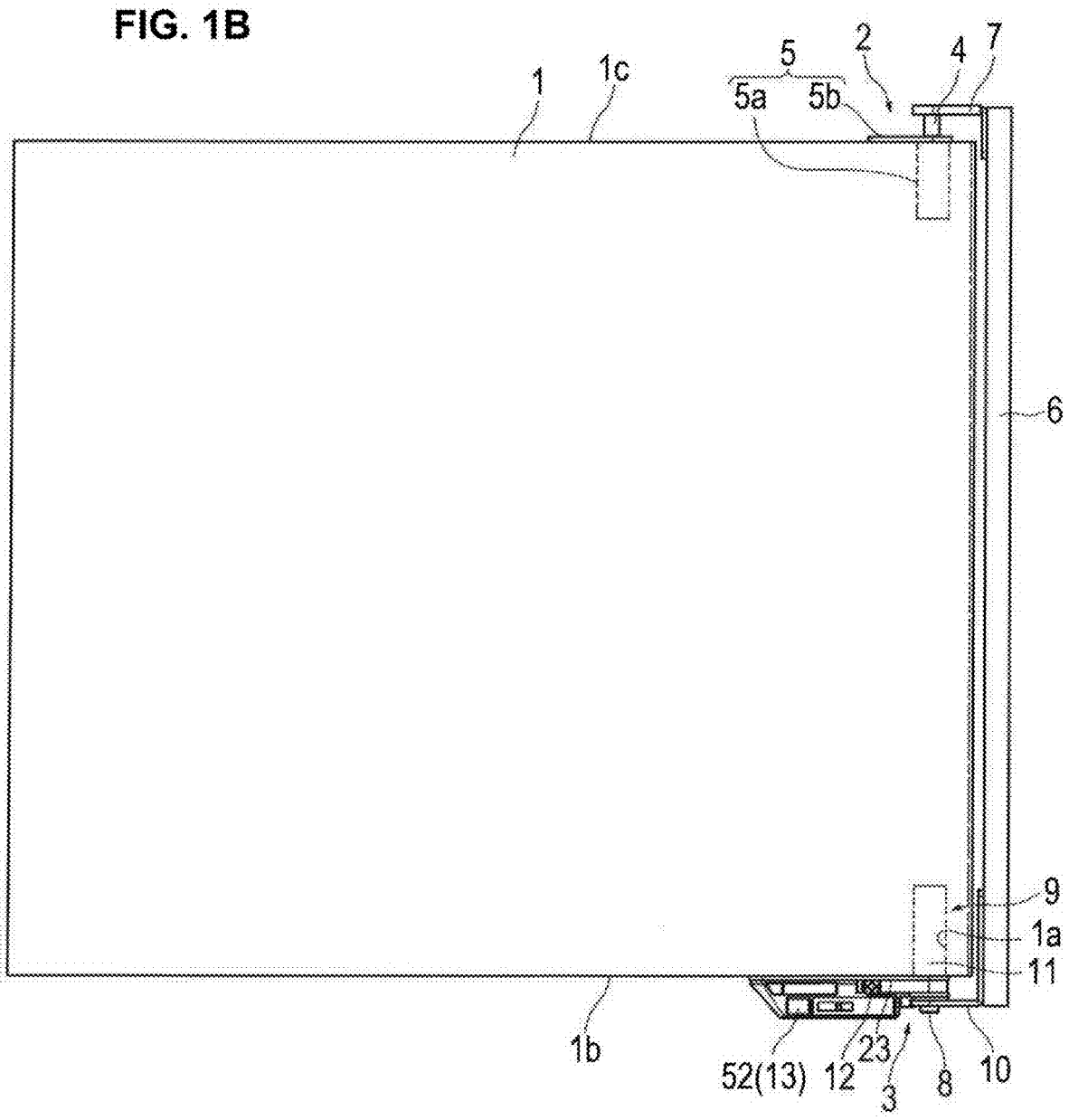

FIGS. 1A and 1B show an example of a hinge device according to an embodiment of the present invention, which is attached to a door 1, such as a counter door. FIG. 1A is a plan view and FIG. 1B is a side view. A hinge device 2 is attached to the upper part of the door. Correspondingly, another hinge device 3 is attached to the lower part of the door 1. The hinge device 3 attached to the lower part of the door 1 is a hinge device according to the present embodiment.

The hinge device 2 at the upper part of the door 1 comprises a shaft member 4 and a case 5. The shaft member 4 is attached to an L-shaped washer 7 which is attached to the upper part of a main body 6, such as a frame. The shaft member 4 is oriented vertically downward. The case 5 comprises a cylindrical portion 5*a* fitted into a hole formed in an upper surface 1*c* of the door 1, and a base 5*b* attached to the upper surface 1*c* of the door 1. The cylindrical portion 5*a* and the base 5*b* are integrated with each other. To the cylindrical portion 5*a*, the shaft member 4 is rotatably fitted. The door 1 is rotatable about the shaft member 4.

The hinge device 3 of the instant embodiment also comprises a shaft member 8 as a first member as well as a case 9 as a second member. The shaft member 8 is attached to an L-shaped washer 10 which is attached to the lower part of the main body 6. The shaft member 8 is oriented vertically upward. The case 9 comprises a cylindrical portion 11 fitted into a hole formed on a lower surface 1*b* of the door 1, and a base 23 attached to the lower surface 1*b* of the door 1. The door 1 is rotatable about the shaft member 8.

The hinge device 3 brings the door 1 rotated from its neutral position to one direction (clockwise) and the other direction (counterclockwise) back to the neutral position. In the hinge device 3, incorporated are a positional adjustment structure 12 for adjusting an angle of the neutral position of the door 1 and a damper structure 13 for producing a damper force when the door 1 returns to the neutral position.

The damper structure 13 comprises a linear damper 52, see FIG. 9. The linear damper 52 is disposed below the lower surface 1*b* of the door 1. In the side view of the door 1 illustrated in FIG. 1B, the door 1 has a rectangular shape, and no notches for placing the linear damper 52 are formed in the lower and upper parts of the door 1.

Hereinafter, the configurations of the hinge device 3, the positional adjustment structure 12 and the damper structure 13 will be described in order.

[Hinge Device]

Figure 2A:
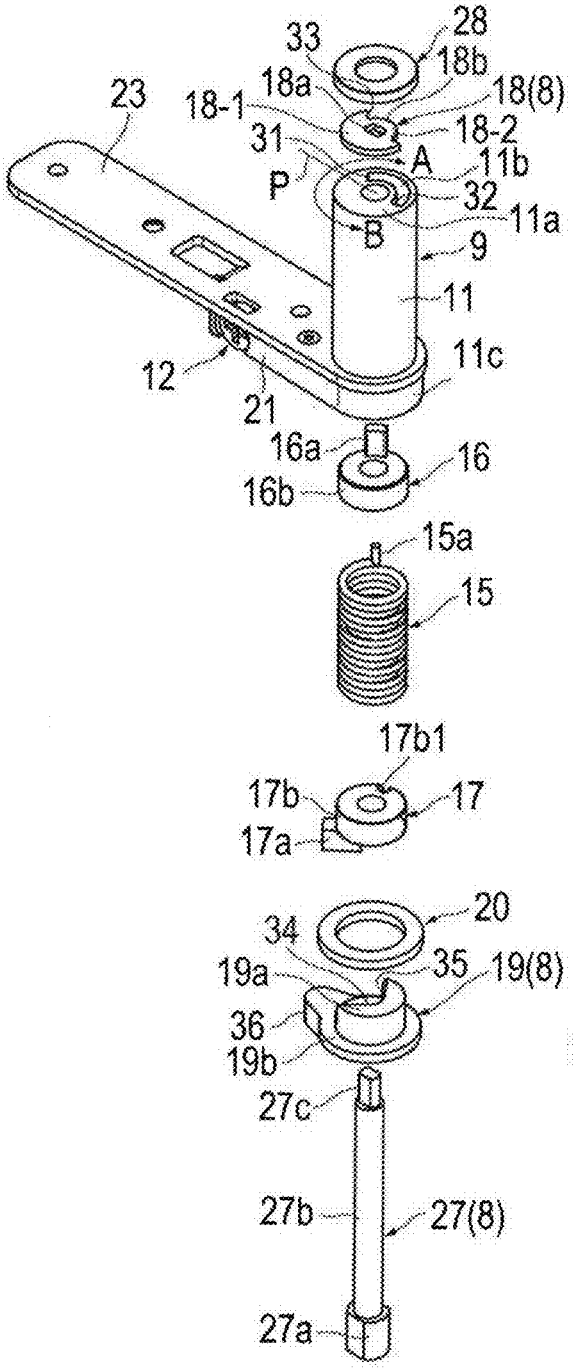
FIGS. 2A and 2B are a perspective view of the hinge device of the illustrative embodiment viewing from its top side, FIG. 2A and FIG. 2B being an exploded perspective view and a perspective view when assembled, respectively
Figure 2B:
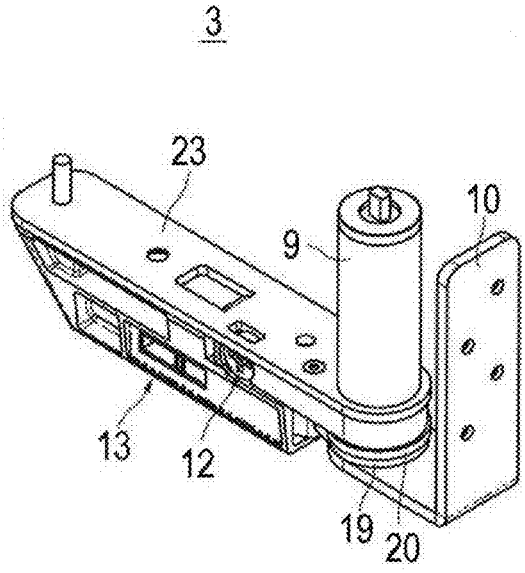
Figure 3A:
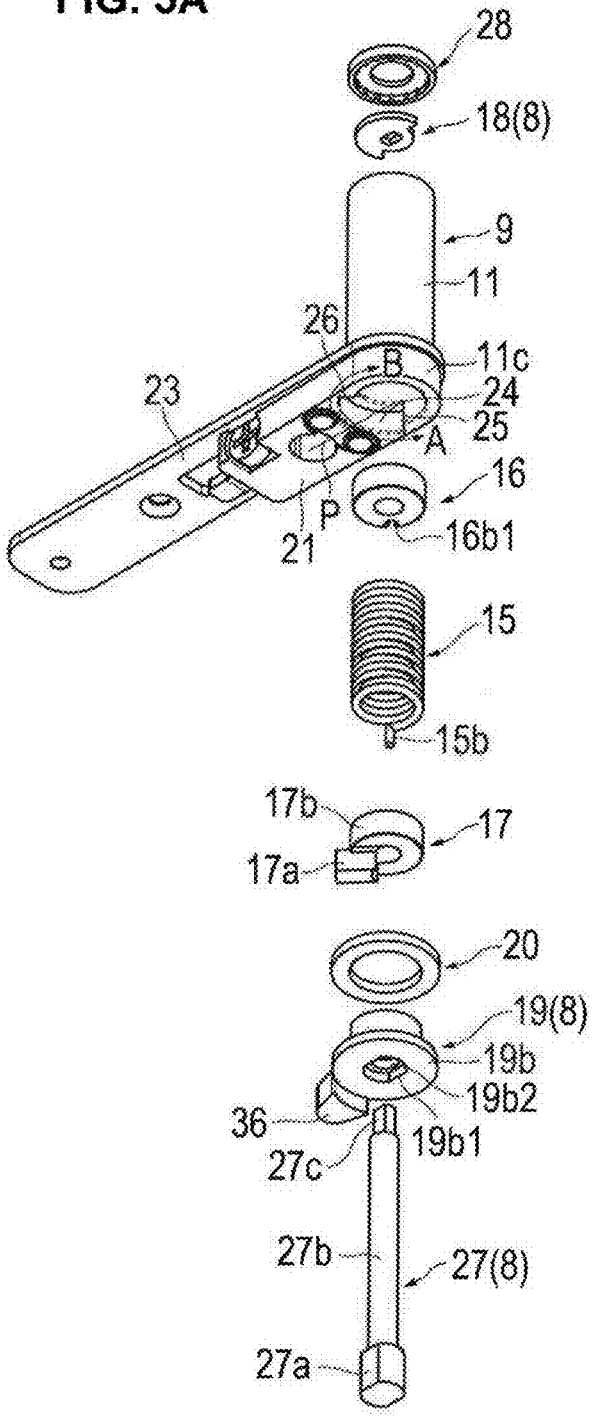
FIGS. 3A and 3B are a perspective view of the hinge device of the illustrative embodiment from its bottom side, FIG. 3A and FIG. 3B being an exploded perspective view and a perspective view when assembled, respectively.
Figure 3B:
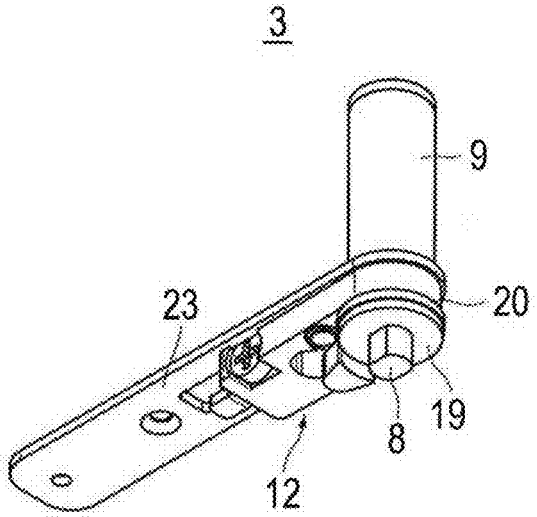

FIGS. 2A and 2B are a top side perspective view of the hinge device 3 of this embodiment, FIG. 2A being an exploded perspective view and FIG. 2B showing the assembled state thereof in a perspective view. FIGS. 3A and 3B are a bottom side perspective view of the hinge device 3 of the instant embodiment, FIG. 3A being an exploded perspective view and FIG. 3B showing an assembled state in a perspective view.

The hinge device 3 comprises the case 9, a coil spring 15 as returning means, a first spring holder 16, a second spring holder 17 and the shaft member 8. The configuration of those components of the hinge device 3 will be described below.

Figure 6A:
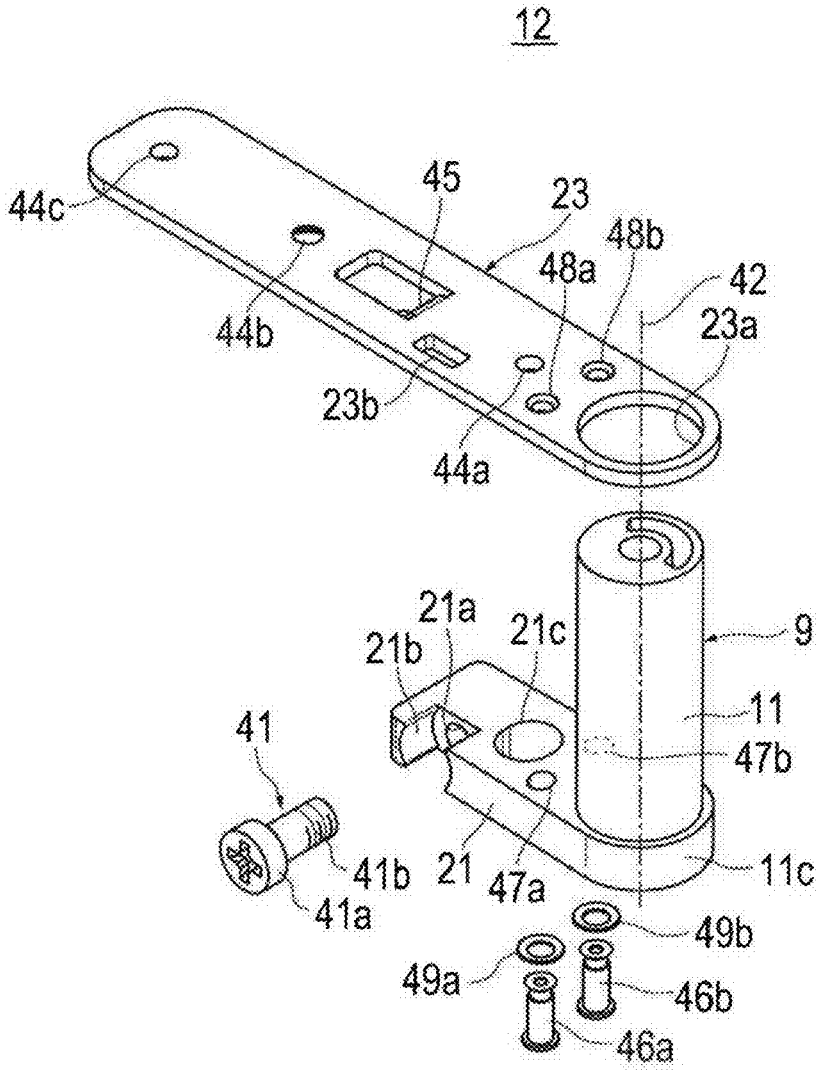
FIGS. 6A and 6B are an exploded perspective view of a positional adjustment structure, FIG. 6A being an exploded perspective view of the positional adjustment structure and FIG. 6B being a perspective view of the positional adjustment structure when assembled.
Figure 6B:
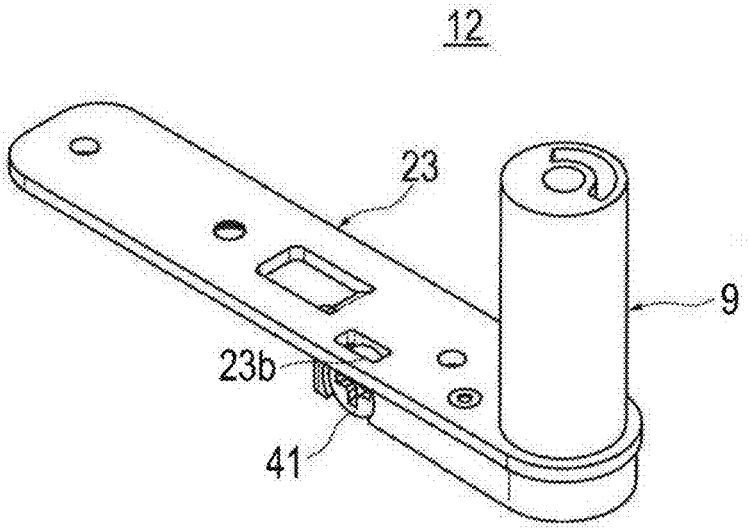

The case 9 comprises a cylindrical portion 11 and an extension portion 21 disposed in the lower end part of the cylindrical portion 11 to extend along the lower surface 1*b* of the door 1, see FIGS. 6A and 6B also. The cylindrical portion 11 and the extension portion 21 may be integrally formed with each other by e.g. resin molding. The case 9 is rotatable about a shaft 27 of the shaft member 8 with respect to a rotation axis 42, FIGS. 6A and 6B. Reference numeral 12 denotes the positional adjustment structure. The details on the positional adjustment structure 12 will be described later.

The cylindrical portion 11 has its upper end part closed, see FIGS. 2A and 2B, and its lower end part opened, see FIGS. 3A and 3B. As shown in FIGS. 2A and 2B, the cylindrical portion 11 has its upper end having an end wall 11*a* integrally formed. The end wall 11*a* is provided with an arc groove 11*b*. The groove 11*b* has its one end serving as a first contact section 31 that comes into contact with an arm 16*a* of the first spring holder 16. When the case 9 is in the neutral position P, the first contact section 31 is in contact with the arum 16*a* of the first spring holder 16. When the case 9 is rotated from the neutral position P in one direction (clockwise direction A) as shown in FIGS. 2A and 2B, the first contact section 31 comes into contact with the arm 16*a* of the first spring holder 16 to thereby rotate the first spring holder 16 in the clockwise direction A. By contrast, when the case 9 is rotated from the neutral position P in the other direction (counterclockwise direction 8) as shown in FIGS. 2A and 2B, the first contact section 31 moves away from the arum 16*a* of the first spring holder 16, so that the first spring holder 16 is not rotated. The groove 11*b* has its other end 32 acting as a stopper for restricting the rotation of the case 9 by coming into contact with the arm 16*a* of the first spring holder 16 when the case 9 is rotated in the counterclockwise direction 8 by e.g. 90 degrees or more.

As shown in FIGS. 3A and 3B, the cylindrical portion 11 has its open end 11*c* at the lower end part thereof which has its outer diameter enlarged to thereby support a base 23. On the open end 11*c*, the extension portion 21 is integrally formed. In addition, the open end 11*c* of the cylindrical portion 11 has a concave part 24 formed into an arc shape curving along the inner side of the cylindrical portion 11. The concave part 24 has its one side wall serving as a second contact section 25 that comes into contact with an arm 17*a* of the second spring holder 17. When the case 9 is rotated from the neutral position P in the counterclockwise direction 8 as shown in FIG. 3A, the second contact section 25 comes into contact with the arm 17*a* of the second spring holder 17 so as to rotate the second spring holder 17 in the counterclockwise direction 8. By contrast, when the case 9 is rotated from the neutral position P in the clockwise direction A as shown in FIG. 3A, the second contact section 25 moves away from the arm 17*a* of the second spring holder 17, and thus the second spring holder 17 is not rotated. The concave part 24 has another side wall 26 acting as a stopper for restricting the rotation of the case 9 by coming into contact with the arm 17*a* of the second spring holder 17 when the case 9 is rotated in the clockwise direction A by e.g. 90 degrees or more.

As shown in FIGS. 2A and 2B, the first spring holder 16 is disposed to the upper end part of the coil spring 15. The first spring holder 16 comprises a ring-like main body portion 16*b* and the arm 16*a* protruding in the axial direction from the upper end surface of the main body portion 16*b*. The main body portion 16*b* and the arm 16*a* are integral with each other. The main body portion 16*b* has its outer diameter almost equal to the inner diameter of the cylindrical portion 11, and has its inner diameter almost equal to the outer diameter of the shaft 27. The main body portion 16*b* is rotatable with respect to the cylindrical portion 11 and the shaft 27. When the first spring holder 16 is inserted into the cylindrical portion 11, the arm 16*a* enters the groove 11*b* and simultaneously protrudes outside the end wall 11*a* of the cylindrical portion 11. On the lower surface of the main body portion 16*b*, a hole 16*b*1 is formed for attaching the first spring holder 16 to the end of the coil spring 15, see FIGS. 3A and 3B.

As shown in FIGS. 3A and 3B, the second spring holder 17 is disposed to the lower end part of the coil spring 15. The second spring holder 17 comprises a ring-like main body portion 17*b* and the arm 17*a* provided on the lower end surface of the main body portion 17*b* and protruding in a radial direction from the main body portion 17*b*. The main body portion 17*b* and the arm 17*a* are integral with each other. As with the first spring holder 16, the main body portion 17*b* has its outer diameter almost equal to the inner diameter of the cylindrical portion 11, while having its inner diameter almost equal to the outer diameter of the shaft 27. The main body portion 17*b* is rotatable with respect to the cylindrical portion 11 and the shaft 27. The arm 17*a* is in the form of a plate and disposed on the lower end surface of the main body portion 17*b*. When the second spring holder 17 is put into the open end 11*c* of the cylindrical portion 11, the tip of the arm 17*a* enters the concave part 24. On the upper surface of the main body portion 17*b*, a hole 17*b*1 is formed for attaching the second spring holder 17 to the end of the coil spring 15, see FIGS. 2A and 2B.

The coil spring 15 is placed inside the cylindrical portion 11. The coil spring 15 has its opposite ends 15*a* and 15*b*, FIGS. 2A through 3B, extending in the axial direction. The ends 15*a* and 15*b* of the coil spring 15 are attached to the first spring holder 16 and the second spring holder 17, respectively. The coil spring 15 is always twisted in its forward, twisting direction. More specifically, when the case 9 is rotated in the clockwise direction A from the neutral position P, the upper end part of the coil spring 15 is rotated in the clockwise direction A so that the coil spring 15 is twisted in the forward direction. When the case 9 is rotated in the counterclockwise direction B from the neutral position P, the lower end part of coil spring 15 is rotated in the counterclockwise direction B so that the coil spring 15 is twisted in the forward direction.

As shown in FIGS. 2A and 2B, the shaft member 8 is fixed to the L-shaped washer 10 in anti-rotatable. The shaft member 8 comprises the shaft 27, a first engaging portion 18 and a second engaging portion 19. The shaft 27 is placed inside the coil spring 15. The first engaging portion 18 and the second engaging portion 19 are not integral with the shaft 27. The first engaging portion 18 and the second engaging portion 19 are fixed to the shaft 27 in anti-rotatable.

The shaft 27 extends in the vertical direction. The shaft 27 comprises a lower end part 27*a* having a larger diameter, an intermediate portion 27*b* and an upper end part 27*c* having a smaller diameter. The second engaging portion 19, a washer 20, the second spring holder 17, the coil spring 15 and the first spring holder 16 are put through the shaft 27, and the upper end part 27*c* of the shaft 27 in turn put through the first engaging portion 18 outside the end wall 11*a* of the case 9 to swage the upper end part 27*c* of the shaft 27, so as to fit those components into the case 9. Reference numeral 28 denotes a cap covering the first engaging portion 18.

The shaft 27 has its lower end part 27*a* generally oval-shaped in cross section and having a pair of parallel flat surfaces formed. The lower end part 27*a* of the shaft 27 is fitted into a hole of the washer 10 in anti-rotatable. The washer 10 has its hole having the shape of oval which is complementary to the lower end part 27*a* of the shaft 27. The upper end part 27*c* of the shaft 27 is also in the shape of oval in cross section. The upper end part 27*c* of the shaft 27 is fitted into a hole 18*a* of the first engaging portion 18 in anti-rotatable. The hole 18*a* is in the shape of oval which is complementary to the upper end part 27*c* of the shaft 27.

As shown in FIGS. 2A and 2B, the first engaging portion 18 has an approximately discal shape. On the outer periphery of the first engaging portion 18, formed is an arc notch 18*b* having the size substantially equal to the arc groove 11*b* of the case 9. For this purpose, the first engaging portion 18 comprises an arc part 18-1 having a larger diameter and another arc part 18-2 having a smaller diameter. Outside the arc part 18-2, the arm 16*a* of the first spring holder 16 is located. When the case 9 is in the neutral position P, the arm 16*a* is in contact with one of shoulders 33 of the arc part 18-1.

The second engaging portion 19 comprises a main body part 19*a* and a flange 19*b* provided in the lower end part of the main body 19*a*. The main body part 19*a* has a notch 34 formed therein having a V-shaped cross section. In the notch 34, the arm 17*a* of the second spring holder 17 is fitted. When the case 9 is in the neutral position P, the arm 17*a* comes into contact with one of side walls 35 of the main body part 19*a*.

As shown in FIGS. 3A and 3B, the flange 19*b* is provided with a hole 19*b*1 having an oval cross section complementary to the lower end part 27*a* of the shaft 27. In the hole 19*b*1, the lower end part 27*a* of the shaft 27 is fitted in anti-rotatable. In addition, in the bottom surface of the hole 19*b*1, formed is a through hole 19*b*2 through which the intermediate part 27*b* of the shaft 27 passes.

As shown in FIGS. 2A and 2B, the flange 19*b* has a V-shaped pointed plate-like cam 36 formed integrally. The cam 36 is disposed below the lower surface 1*b* of the door 1. The cam 36 cooperates with the damper structure 13. The damper structure 13 generates a damper force when the door 1 returns to the neutral position P so as to allow the door 1 to close slowly. The configuration of the damper structure 13 will be described later.

The second engaging portion 19 is placed on the upper surface of the washer 10. On the upper surface of the flange 19*b* of the second engaging portion 19, the washer 20 made of a resin is mounted. The case 9 is rotatably supported on the second engaging portion 19 via the washer 20. The case 9 is guided in rotation by the second engaging portion 19, the first spring holder 16 and the second spring holder 17.

Figures 4A, 4B, 4C:
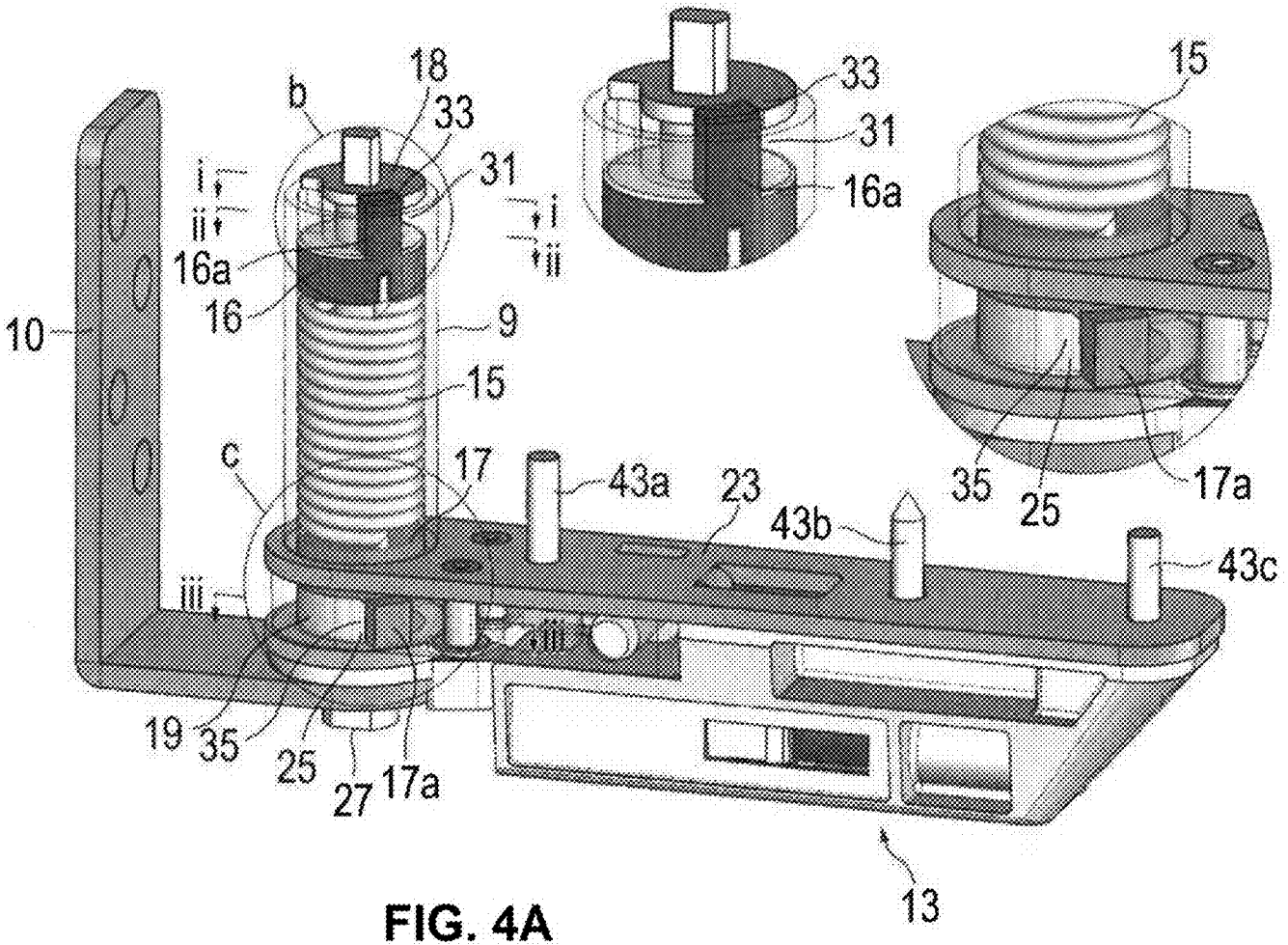
FIGS. 4A through 4C are a perspective view of the hinge device when assembled, FIG. 4A being an overall view, FIG. 4B being an enlarged view of the portion b shown in FIG. 4A, and FIG. 4C being an enlarged view of the portion c in FIG. 4A.

FIGS. 4A through 4C are a perspective view of the hinge device 3 in the neutral position P, FIG. 4A being an overall view, FIG. 4B being an enlarged view of the portion b in FIG. 4A, and FIG. 4C is an enlarged view of the portion c in FIG. 4A. In FIG. 4A, the case 9 is illustrated as transparently to clarify the internal structure of the case 9.

When the case 9 is in the neutral position P, the arm 16*a* of the first spring holder 16 at the upper end of the coil spring 15 comes into contact with one of the shoulders 33 of the first engaging portion 18 fixed to the shaft 27, and consequently the arm 17*a* of the second spring holder 17 at the lower end of the coil spring 15 comes into contact with one of the side walls 35 of the second engaging portion 19 fixed to the shaft 27. At this time, the first contact section 31 of the case 9 comes into contact with the arm 16*a* of the first spring holder 16, while the second contact section 25 of the case 9 comes into contact with the arm 17*a* of the second spring holder 17. In this case, the coil spring 15 is in the twisted state.

Figures 5A, 5B, 5C:
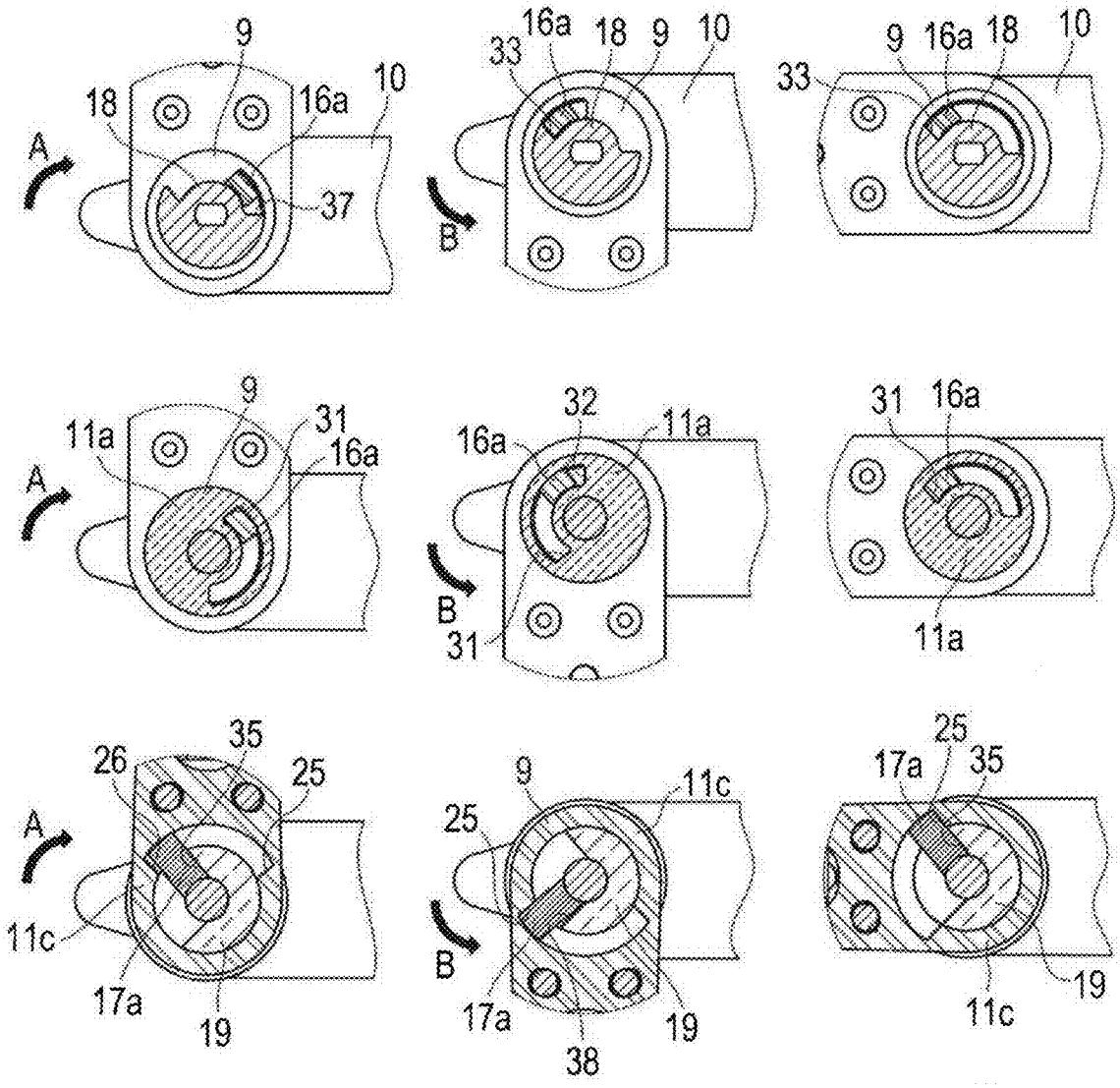
FIGS. 5A through 5C show an internal structure of the hinge device when a case is rotated clockwise and counterclockwise from its neutral position, FIG. 5A showing a state where the case is in its neutral position, FIG. 5B showing a state where the case is rotated counterclockwise.

FIGS. 5A through 5C show the internal structure of the hinge device 3 when the case 9 is rotated from the neutral position P in the clockwise direction A and counterclockwise direction B. FIG. 5A shows a state where the case 9 is in the neutral position P, FIG. 5B shows a state where the case 9 is rotated from the neutral position P in the counterclockwise direction B, and FIG. 5C shows a state where the case 9 is rotated from the neutral position P in the clockwise direction A. The top section of FIGS. 5A through 5C show a horizontal cross sectional view of the first engaging portion 18 with a cross sectional view taken along i-i line in FIG. 4A, the middle section of FIGS. 5A through 5C show a horizontal cross sectional view of the end wall 11*a* of the case 9 with a cross sectional view taken along ii-ii line in FIG. 4A, and the bottom section of FIGS. 5A through 5C show a horizontal cross sectional view of the open end 11*c* of the case 9 and the second engaging portion 19 with the cross sectional view taken along iii-iii line in FIG. 4A.

When the case 9 is in the neutral position P, the arm 16*a* of the first spring holder 16 is, as shown in the top section of FIGS. 5A through 5C, FIG. 5A in contact with the shoulder 33 of the first engaging portion 18. As shown in the bottom section of FIG. 5A the arm 17*a* of the second spring holder 17 comes into contact with the side wall 35 of the second engaging portion 19. At this time, as shown in the middle section of FIG. 5A, the first contact section 31 of the case 9 is in contact with the arm 16*a* of the first spring holder 16, and as shown in the bottom section of FIG. 5A, the second contact section 25 of the case 9 is in contact with the arm 17*a* of the second spring holder 17.

When the case 9 is rotated from the neutral position P in the clockwise direction A, as shown in the middle section of FIG. 5C, the arm 16*a* of the first spring holder 16 abutting the first contact section 31 of the case 9 is rotated together with the case 9 in the clockwise direction A. As shown in the top section of FIG. 5C, the rotation in the clockwise direction A of the arm 16*a* of the first spring holder 16 is not blocked by the first engaging portion 18. By contrast, as shown in the bottom section of FIG. 5C, the second contact section 25 of the case 9 moves away from the arm 17*a* of the second spring holder 17, whereas the arm 17*a* of the second spring holder 17 remains in contact with the side wall 35 of the second engaging portion 19. As a consequence, the coil spring 15 is twisted, and thus a force in a direction where the coil spring 15 is untwisted, i.e. counterclockwise direction B, is exerted on the case 9. When the case 9 is released, the case 9 returns automatically to the neutral position P.

When the case 9 is rotated from the neutral position P in the clockwise direction A by 90 degrees or more, the arm 16*a* of the first spring holder 16 comes into contact with the shoulder 37 of the first engaging portion 18 as shown in the top section of FIG. 5C, or the side wall 26 of the case 9 comes into contact with the second spring holder 17 as shown in the bottom section of FIG. 5C, so as to restrict 90 degrees or more rotation of the case 9.

When the case 9 is rotated in the counterclockwise direction B, the arm 17*a* of the second spring holder 17 abutting the second contact section 25 of the case 9 is rotated along with the case 9 in the counterclockwise direction B, as shown in the bottom section of FIG. 5B. By contrast, the first contact section 31 of the case 9 moves away from the arm 16*a* of the first spring holder 16 as shown in the middle section of FIG. 5B, whereas the arm 16*a* of the first spring holder 16 remains in contact with the shoulder 33 of the first engaging portion 18. As a consequence, the coil spring 15 is twisted, and thus a force in a direction where the coil spring 15 is untwisted, i.e. clockwise direction A, is exerted on the case 9. When the case 9 is released, the case 9 returns automatically to the neutral position P.

When the case 9 is rotated from the neutral position P in the counterclockwise direction B by 90 degrees or more, the arm 17*a* of the second spring holder 17 comes into contact with the side wall 38 of the second engaging portion 19 as shown in the bottom section of FIG. 5B, or the other end 32 of the groove 11*b* of the case 9 comes into contact with the arm 16*a* of the first spring holder 16 as shown in the middle section of FIG. 5B, so as to restrict 90 degrees or more rotation of the case 9.

[Positional Adjustment Structure]

FIGS. 6A and 6B are a perspective view of the positional adjustment structure 12. FIG. 6A is an exploded perspective view of the positional adjustment structure 12, and FIG. 6B is a perspective view showing the positional adjustment structure 12 in an assembled state. Reference numeral 9 denotes the case, numeral 41 denotes a position adjusting screw as position adjusting member, and numeral 23 denotes the base.

As described above, the case 9 as a second member comprises the cylindrical portion 11 and the extension portion 21. The case 9 has its extension portion 21 formed integrally with the open end 11*c* of the cylindrical portion 11. The case 9 is rotatable about the rotation axis 42 with respect to the shaft member 8 as the first member.

The position adjusting screw 41 comprises a head 41*a* and a screw part 41*b*. The position adjusting screw 41 is oriented in a direction perpendicular to the rotation axis 42.

The extension portion 21 is provided with a screw hole 21*a* into which the position adjusting screw 41 is screwed. On the side surface of the extension portion 21, a notch 21*b* complementary to the head 41*a* of the position adjusting screw 41 is formed. The head 41*a* has its outer diameter greater than the thickness of the extension portion 21. The head 41*a* partially protrudes upward from the extension portion 21.

The base 23 has a substantially rectangular plate shape extending along the lower surface 1*b* of the door 1. On one end in a length direction of the base 23, a round hole 23*a* is formed. The hole 23*a* has its diameter almost the same as the outer diameter of the cylindrical portion 11 of the case 9. The base 23 is rotatable about the rotation axis 42 of the case 9 with respect to the case 9.

The base 23 is provided with an approximately rectangular opening 23*b* into which the head 41*a* of the position adjusting screw 41 is inserted. The opening 23*b* of the base 23 has its edge engageable with the head 41*a* of the position adjusting screw 41. When the position adjusting screw 41 is turned by using a tool such as a screwdriver, the position adjusting screw 41 is moved in the axial direction with respect to the case 9, and thus the base 23 engaging with the head 41*a* swings clockwise and counterclockwise around the rotation axis 42.

On the base 23, through holes 44*a*, 44*b*, 44*c* are formed, through which fastening members 43*a*, 43*b* and 43*c*, FIGS. 4A through 4C, are inserted for attaching the base 23 to the door 1. The fastening member 43*a* is a screw for attaching the base 23 to the door 1. An escaping hole 21*c* is formed in the extension portion 21 of the case 9 to avoid interference with the head of the fastening member 43*a*. The fastening member 43*b* is a flat-head screw for attaching the base 23 to the door 1. On the lower surface of the through hole 44*b* of the base 23, a conical countersunk hole 44*b*1 is formed for avoiding interference between the head of the fastening member 43*b* and the damper structure 13, see FIGS. 7A through 7B. The fastening member 43*c* is a screw for jointly fastening the base 23 and the damper structure 13 to the door 1. A through hole 51*a* is formed in a damper case 51 of the damper structure 13, through which the fastening member 43*c* passes, see FIG. 8. The base 23 is also provided with a bent piece 45 for positioning the damper case 51 of the damper structure 13.

As shown in FIGS. 6A and 6B, the case 9 and the base 23 are coupled to each other with coupling shafts 46*a* and 46*b* substantially parallel to the rotation axis 42. The case 9 has its extension portion 21 provided with substantially arc-shaped elongate holes 47*a* and 47*b* through which the coupling shafts 46*a* and 46*b* pass respectively. On the base 23, through holes 48*a* and 48*b* are formed for passing the coupling shafts 46*a* and 46*b* respectively therethrough. After the coupling shafts 46*a* and 46*b* pass through the elongate holes 47*a* and 47*b* of the case 9 and the through holes 48*a* and 48*b* of the base 23, respectively, the tips of the coupling shafts 46*a* and 46*b* are fixed to the base 23 by washers 49*a* and 49*b*, respectively. The base 23 can swing within the elongate holes 47*a* and 47*b* with respect to the case 9.

Figure 7A:
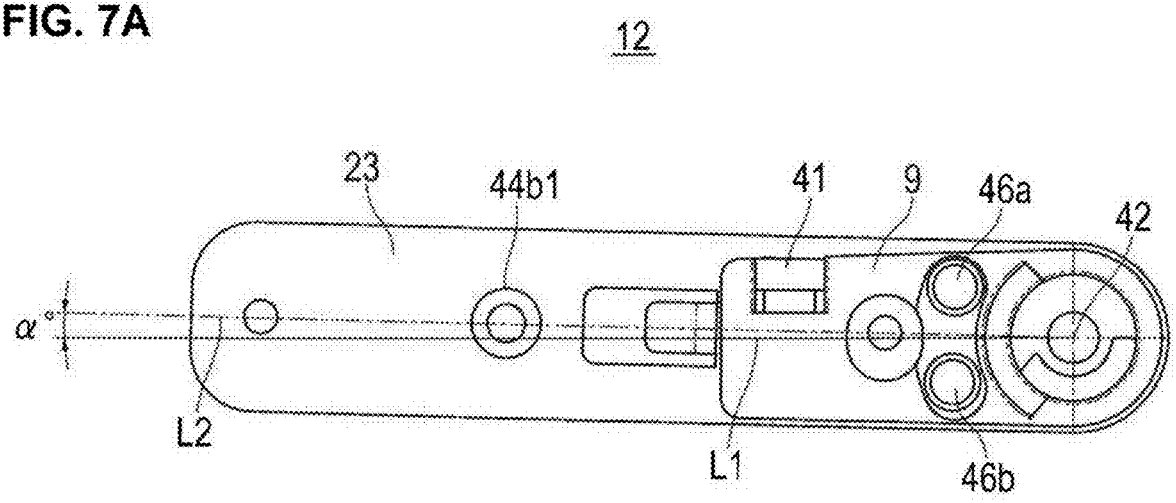
FIGS. 7A through 7C are a bottom view of the positional adjustment structure, FIG. 7A showing a state where a base is swung clockwise with respect to the case, FIG. 7B showing a state where a center line of the case is aligned with a center line of the base, and FIG. 7C showing a state where the base is swung counterclockwise with respect to the case.
Figure 7B:
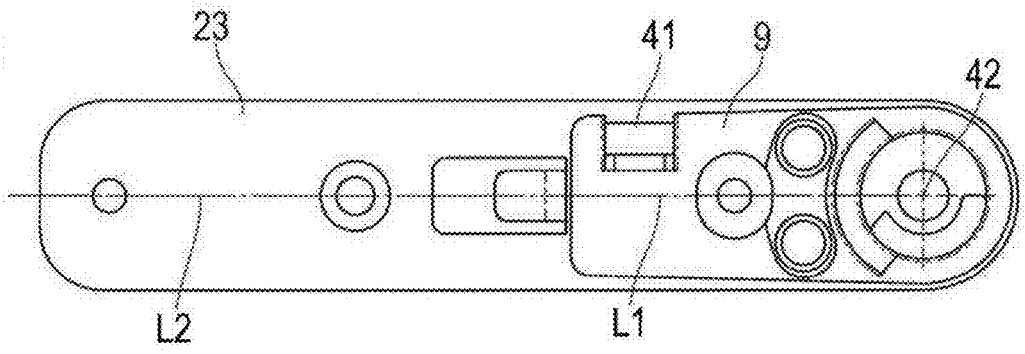
Figure 7C:
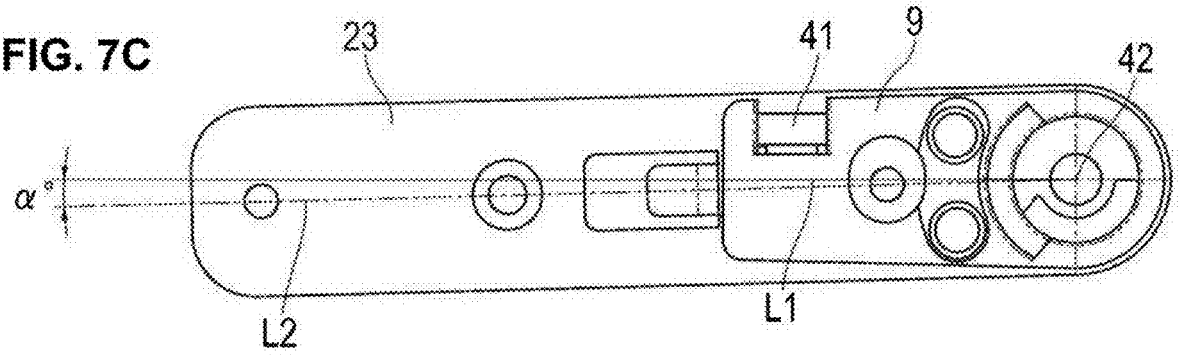

FIGS. 7A through 7C are a bottom view of the positional adjustment structure 12. FIG. 7B shows a state where a center line L1 of the case 9 is aligned with a center line L2 of the base 23, FIG. 7A shows a state where the position adjusting screw 41 is loosen to swing the case 23 clockwise with respect to the case 9, and FIG. 7C shows a state where the position adjusting screw 41 is tightened to swing the base 23 counterclockwise with respect to the case 9.

As described above, the base 23 can swing around the rotation axis 42 with respect to the case 9. In addition, the position adjusting screw 41 is bridged between them. Thus, when the position adjusting screw 41 is turned, an angle α formed between the case 9 and the base 23 about the rotation axis 42 can be adjusted, where a denotes an angle formed by the center line L1 of the case 9 and the center line L2 of the base 23. Since the door 1 is attached to the base 23, the position of the door 1 can be adjusted. Furthermore, as the position of the door 1 can be adjusted while confirming the position of the tip of the door 1 in the state where the door 1 is attached to the base 23, the positional adjustment of the door 1 can be conducted easily.

[Damper Structure]

Figure 8:
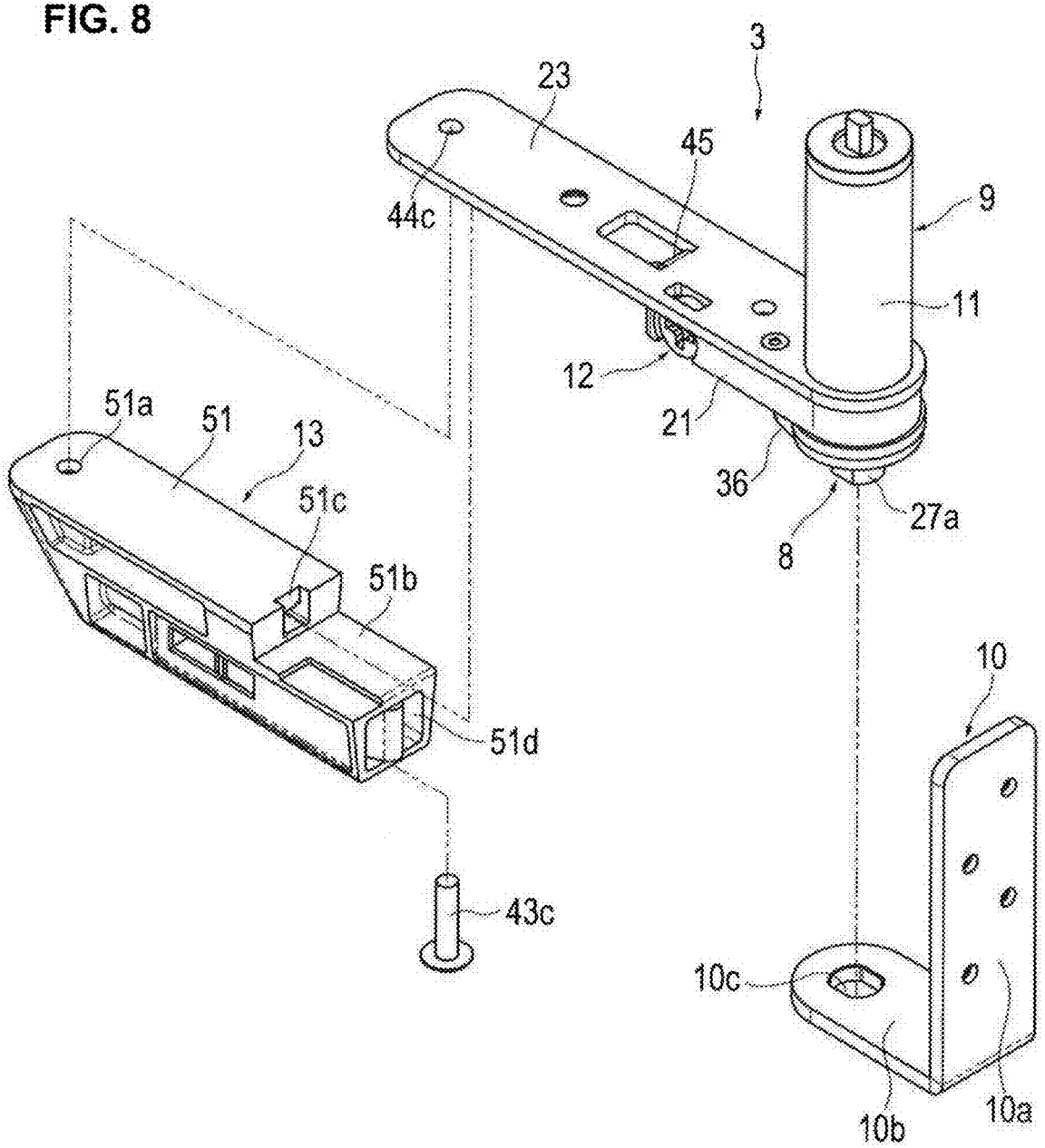
FIG. 8 is an exploded perspective view showing the hinge device, a damper structure and a washer.

FIG. 8 is an exploded perspective view showing the hinge device 3, the damper structure 13 and the washer 10. The washer 10 comprises a vertical portion 10*a* attached to the main body 6 and a horizontal portion 10*b*. To the horizontal portion 10*b*, the shaft member 8 is attached in anti-rotatable. In addition, a hole 10*c* is formed in the horizontal portion 10*b*, into which hole the lower end part 27*a* of the shaft member 8 is inserted in anti-rotatable. The hole 10*c* is of the shape of oval which is complementary to the lower end part 27*a* of the shaft member 8. The shaft member 8 is provided with the cam 36.

FIG. 9 is an exploded perspective view of the damper structure 13. The damper structure 13 comprises the damper case 51, the linear damper 52 and a slider 53. The damper case 51 has an approximately rectangular parallelepiped shape extending along the lower surface 1*b* of the door 1. A holding space 51*d* for the linear damper 52 is formed in the damper case 51. On the upper part of the damper case 51, a step 51*b* for avoiding interference with the extension portion 21, FIG. 8, of the case 9 is formed.

As shown in FIG. 8, the damper case 51 is attached to the lower surface of the base 23 by means of the fastening member 43*c*. The base 23 is attached to the lower surface 1*b* of the door 1 by means of the fastening members 43*a*, 43*b*, see FIGS. 4A through 4C. On one end of the damper case 51, formed is a hole 51*a* for passing the fastening member 43*c* therethrough. A concave part 51*c*, in which the bent piece 45 of the base 23 is fitted, is formed in the shoulder of the damper case 51 in order to position the damper case 51 with respect to the base 23.

As shown in FIG. 9, the slider 53 is slidably fitted into the holding space 51*d* of the damper case 51. The slider 53 is of a square cylindrical form. The slider 53 has its tip provided with a V-shaped convex part 53*a*. Reference numeral 53*b* denotes a stopper for the slider 53.

The linear damper 52 comprises a main body 52*b* and a rod 52*a* which is movable to the main body 52*b*. A return spring, not shown, for returning the linear damper 52 to an extended state is incorporated in the main body 52*b*. Furthermore, the main body 52*b* is filled with a viscous fluid. The rod 52*a* has its base end provided with a piston moving inside the main body 52*b*. The movement of the piston inside the main body 52*b* produces a damper force.

The linear damper 52 resides between the slider 53 and the damper case 51. Into the damper case 51, a position adjusting screw 54 for adjusting the position of the linear damper 52 is screwed. The position adjusting screw 54 has its tip rendered in contact with the linear damper 52. When the position adjusting screw 54 is turned, the linear damper 52 is adjusted in position, and as a consequence the damper force is adjusted.

FIGS. 10A through 10B are a bottom view of the hinge device 3 useful for understanding an operation of the damper structure 13. FIG. 10A shows the neutral position P of the case 9, FIG. 10B shows a state where the case 9 is rotated from the neutral position P in the counterclockwise direction (direction A in FIG. 2A) by about 90 degrees, and FIG. 100 shows a state where the case 9 is rotated from the neutral position P in the clockwise direction (direction B in FIG. 2A) by about 90 degrees.

The case 9 rotated clockwise and counterclockwise from the neutral position P is applied with the urging force for returning the case back to the neutral position P by the coil spring 15, see FIGS. 2A and 2B. The case 9 is then rotated about the shaft member 8 to automatically return to the neutral position P. At this time, the linear damper 52 is held in the damper case 51 and is rotated about the shaft member 8 together with the case 9. The linear damper 52 is always oriented in the direction of the shaft member 8.

When the case 9 returns to the neutral position P, the cam 36 of the shaft member 8 comes into contact with the convex part 53*a* of the slider 53, and thus the slider 53 is pushed into the damper case 51. As a consequence, the linear damper 52 is compressed to generate a damper force in the linear damper 52, thereby allowing the case 9 to slowly return to the neutral position P.

The configuration of the hinge device 3 according to the illustrative embodiment has been described above. The hinge device 3 of the present embodiment can produce the following effects.

Since the linear damper 52 is disposed below the lower surface 1*b* of the door 1, there is no need to machine the door 1 to form a notch therein for placing the linear damper 52. The hinge device 3 can be attached to the door 1 simply by forming the hole 1*a* for fitting the cylindrical portion 11 of the case 9 in the lower surface 1*b* of the door 1. Thus, the machining of the door 1 can be minimized.

As the base 23 is attached to the lower surface 1*b* of the door 1 by the fastening members 43*a* and 43*b*, and the damper case 51 is in turn attached to the lower surface of the base 23 by the fastening member 43*c* to place the linear damper 52 in the damper case 51, the linear damper 52 can be easily disposed below the lower surface 1*b* of the door 1.

Since the coil spring 15 is placed in the cylindrical portion 11 of the case 9 to utilize twisting torque of the coil spring 15 to return the door 1 to the neutral position P, it is possible to return the door 1 to the neutral position P with the same urging force when the door 1 is rotated either in the clockwise or counterclockwise direction. In addition to that, when the door 1 is in the neutral position P, the coil spring 15 is twisted, so that the door 1 can be returned reliably to the neutral position P.

It is to be noted that the present invention is not limited to the embodiment described above, but various embodiments may be implemented without changing the gist of the invention. It is to be appreciated that those skilled in the art can change or modify the embodiments without departing from the scope and spirit of the present invention.

Although the linear damper is disposed below the lower surface of the door in the above-described embodiment, the door shown in FIG. 1B, may be inverted so as to locate the linear damper above the upper surface of the door.

The coil spring that brings the door back to the neutral position is disposed to the hinge device attached on the lower side of the door in the illustrative embodiment, but can be disposed to the hinge device attached on the upper side of the door.

The door in the illustrative embodiment is returned to the neutral position, but can be returned to a closed position or an open position instead of the neutral position.

Although the case and the base are formed separately from each other for the purpose of door positional adjustment in the illustrative embodiment, the case and the base can be integrated if no door positional adjustment is required.

The configuration of the components of the hinge device according to the above embodiment is merely exemplified, and thus other configurations may be employed without changing the gist of the invention.

What is claimed is:

1. A hinge device attached to a door, comprising:

a first member attached to a main body;

a second member attachable to the door and rotatable about a vertical rotation axis relative to the first member;

a cam provided on the first member; and a linear damper provided to the second member and actuatable by the cam, wherein the second member is provided with a base attachable to a lower surface or an upper surface of the door by a fastening member, and the linear damper is placed in a damper case that is separated from the second member and attached to the base by the fastening member.

2. The hinge device in accordance with claim 1, wherein the first member has a shaft member, the second member has a cylindrical portion into which at least part of the shaft member is inserted, and a hole into which the cylindrical portion of the second member is fitted is formed on the lower or upper surface of the door.

3. The hinge device in accordance with claim 2, wherein a coil spring is placed in the cylindrical portion of the second member, a first spring holder on one end of the coil spring is engaged with a first engaging portion of the shaft member while a second spring holder on the other side of the coil spring is engaged with a second engaging portion of the shaft member in order to make the coil spring to be twisted, when the second member is rotated from the neutral position in one direction, a first contact section of the second member comes into contact with the first spring holder to rotate the first spring holder in the one direction, thereby twisting the coil spring, and when the second member is rotated from the neutral position to the other direction, a second contact section of the second member comes into contact with the second spring holder to rotate the second spring holder in the other direction, thereby twisting the coil spring.

4. The hinge device in accordance with claim 1, wherein the cam is configured to actuate the linear damper when the door having rotated from a neutral position in one direction or another direction is returned to the neutral position.

* * * * *